US005473316A

United States Patent [19]

Takaya

[11] Patent Number: 5,473,316

[45] Date of Patent: Dec. 5, 1995

[54] RADIO PAGER WITH AN ELECTRONIC MEMORANDUM FUNCTION

[75] Inventor: Kei Takaya, Tokyo, Japan

[73] Assignee: NEC Corporation, Japan

[21] Appl. No.: 139,522

[22] Filed: Oct. 20, 1993

[30] Foreign Application Priority Data

Oct. 21, 1992 [JP] Japan ..... 4-282644

[51] Int. Cl.[6] ..... G08B 21/00

[52] U.S. Cl. ..... 340/686; 340/825.44; 340/687; 340/825.4

[58] Field of Search ..... 340/686, 687, 340/7, 825.44, 825.4, 311.1, 545, 573; 379/96, 57, 86; 455/343, 347, 348

[56] References Cited

U.S. PATENT DOCUMENTS 4,382,688 5/1983 Machamer ..... 340/309.4
4,644,351 2/1987 Zabarsky et al. ..... 340/825.44
4,845,772 7/1989 Metroka et al. ..... 379/61
5,043,721 8/1991 May ..... 340/825.44

FOREIGN PATENT DOCUMENTS

0501282A1 2/1992 European Pat. Off. .
225350 9/1992 United Kingdom .
WO9013951 11/1990 WIPO .

*Primary Examiner*—John K. Peng
*Assistant Examiner*—Benjamin C. Lee
*Attorney, Agent, or Firm*—Whitham, Curtis, Whitham & McGinn

[57] ABSTRACT

A radio pager having a pager body provided with a keyboard for implementing an electronic memorandum, a lid provided with a display for selectively displaying a received message or data meant for the electronic memorandum, and a hinge connecting the pager body and lid. The pager has a detecting section for detecting the opening of the lid. When the lid is opened as detected by the detecting section, an alert stopping section stops an alerting operation immediately.

2 Claims, 3 Drawing Sheets

RADIO PAGER WITH AN ELECTRONIC MEMORANDUM FUNCTION

BACKGROUND OF THE INVENTION

The present invention relates to a radio pager and, more particularly, to a radio pager having an electronic memorandum function.

There has been extensively used a radio pager of the type having a switch which may be operated by the user of the pager to stop an alert in the event of reception of a call. To provide this type of pager with an electronic memorandum function or similar extra function, a keyboard for the memorandum and a display for displaying memorandum data are respectively mounted on a pager body and a lid constituting the pager. The pager body and lid are openably connected together by a hinge. The problem with a pager of the type described is that, when an alert is produced to alert the user to an incoming call, the user has to press an alert stop switch, open the lid, and then read a received message appearing on the display.

SUMMARY OF THE INVENTION

It is, therefore, an object of the present invention t o provide a radio pager with an electronic memorandum function which automatically stops an alerting operation when a lid thereof is opened.

In accordance with the present invention, a radio pager has a pager body provided with a keyboard for implementing an electronic memorandum, a lid provided with a display for selectively displaying a received message or data meant for the electronic memorandum, and a hinge connecting the pager body and lid. A detecting section detects opening of the lid. An alert stopping section stops an alerting operation when the lid is opened as detected by the detecting section.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1A:
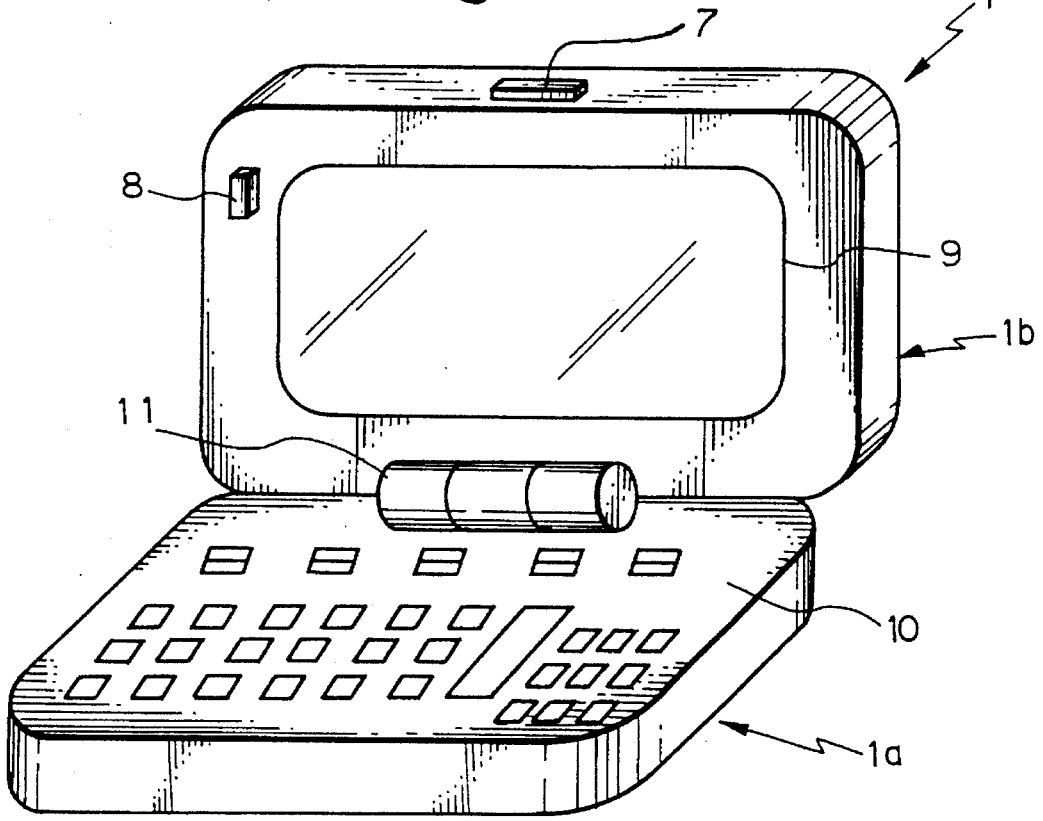
FIGS. 1A and 1B are perspective views showing a radio pager embodying the present invention in an open condition and a closed condition, respectively.
Figure 1B:
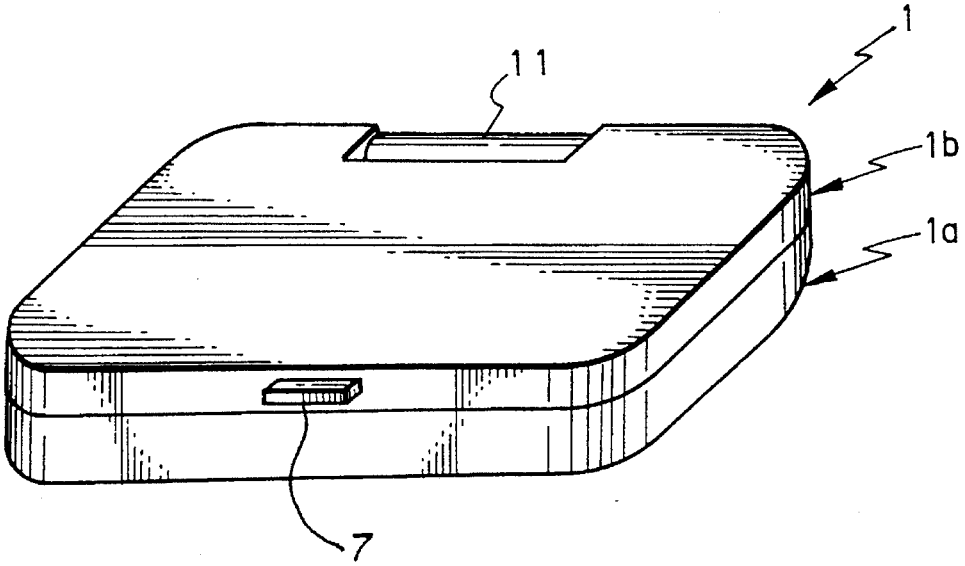

Referring to FIGS. 1A and 1B of the drawings, a radio pager embodying the present invention is shown. As shown, the radio pager, generally 1, has a lid 1*b* and a pager body 1*a* connected together by a hinge 11. The lid 1*b* is provided with a display 9 for selectively displaying a received message or data meant for an electronic memorandum, and a switch 8 associated with the memorandum. A keyboard 10 is arranged on the pager body 1*a*. FIGS. 1A and 1B show the lid 1*b* in an open position and a closed position, respectively.

Figure 2:
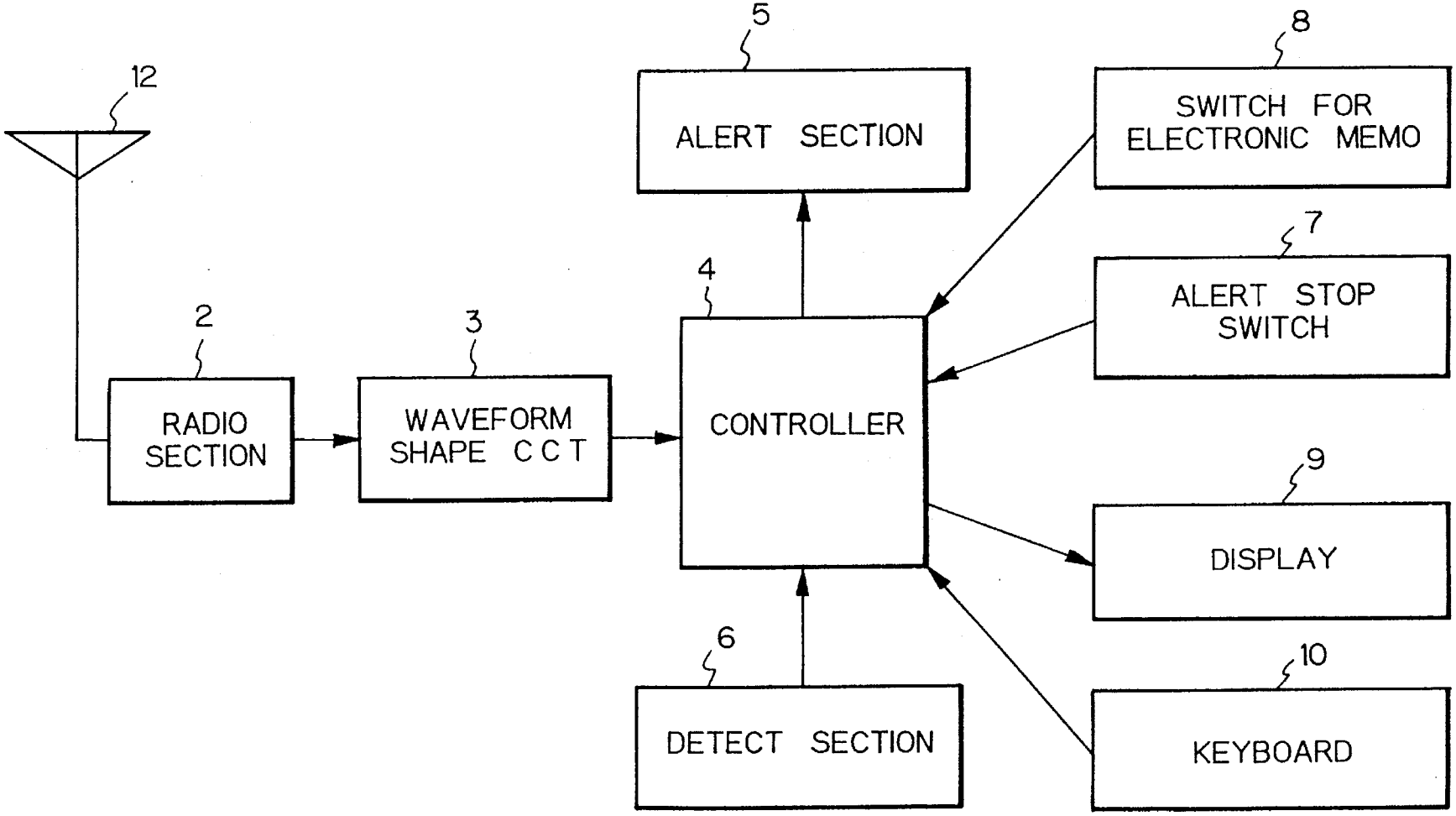
FIG. 2 is a block diagram schematically showing the embodiment.

FIG. 2 is a schematic block diagram representative of an electrical arrangement incorporated in the pager 1. As shown, the pager 1 includes a radio section 2 which receives a radio signal from an antenna 12, amplifies it, and then demodulates it. A waveform shaping circuit 3 shapes the waveform of the demodulated signal to transform it to a digital signal. An alert section 5 generates an alert signal to inform the user of the pager of an incoming call. A detecting section 6 determines whether or not the lid 1*b* is open. An alert stop switch 7 may be operated to stop an alert manually. The switch 8 associated with the memorandum will be operated when the electronic memorandum function is desired. The blocks 3, 5, 6, 7 and 8, as well as the previously mentioned display 9 and keyboard 10, are connected to a controller 4.

In operation, a radio signal coming in through the antenna 12 is amplified and then demodulated by the radio section 2. The demodulated signal is transformed by the waveform shaper 3 to a digital signal which the controller 4 can read. The controller 4 compares an address number included in the digital signal with an address number assigned to and stored in the pager 1. If the two address numbers are identical, the controller 4 causes the alert section 5 to produce an alert. As the user presses the alert stop switch 7, the alert stops. Assume that the user has opened the lid 1*b* without pressing the alert stop switch 7. Then, the detecting section 6 detects the opening of the lid 11 via the switch for electronic memorandum and reports it to the controller 4. In response, the controller 4 causes the alert section 5 to stop producing the alert.

Figure 3:
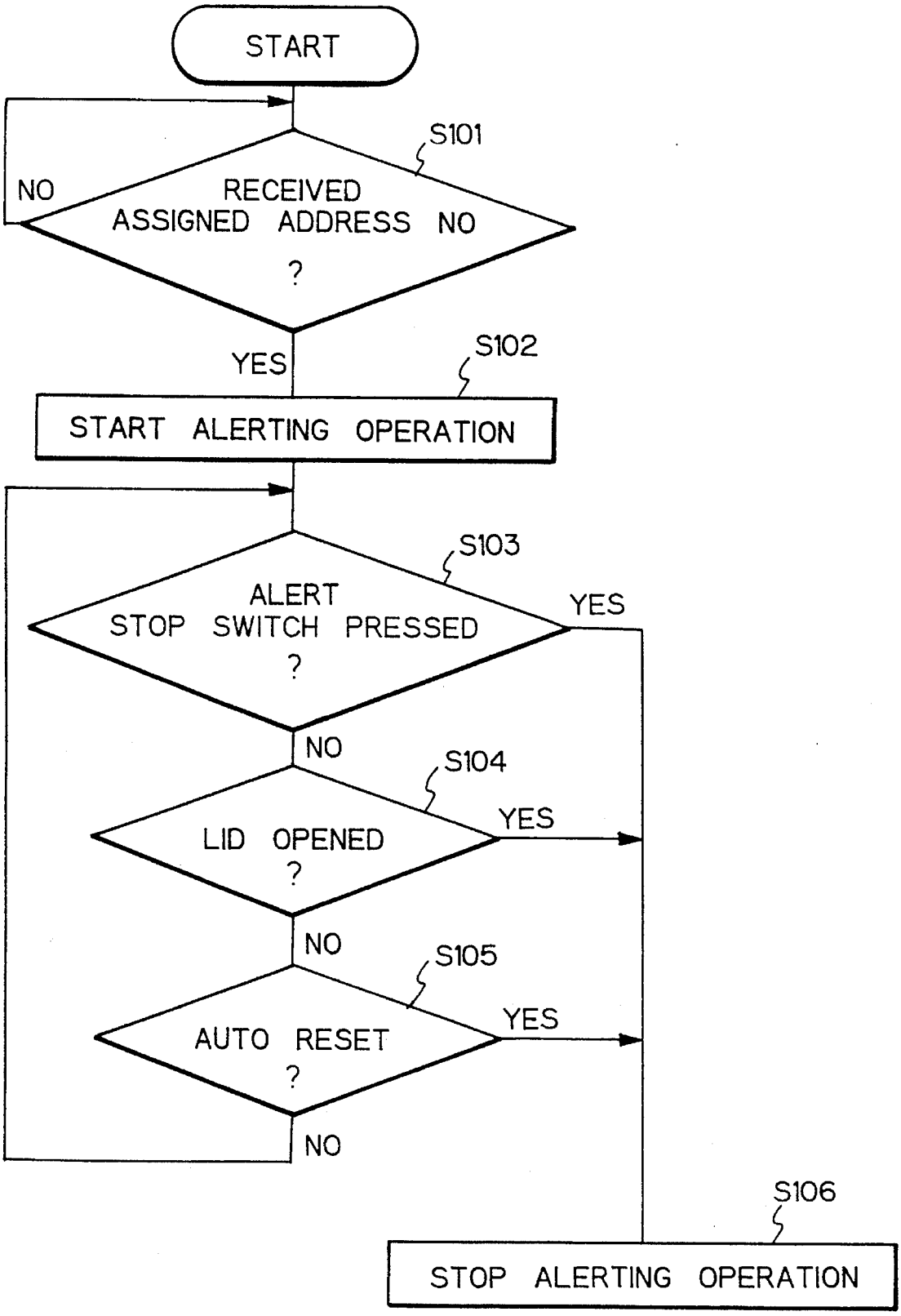
FIG. 3 is a flowchart demonstrating a specific operation of the embodiment.

How the pager 1, i.e., controller 4 stops producing an alert will be described more specifically with reference to FIG. 3. As shown, the controller 4 determines whether or not an address number identical with the address number assigned thereto has been received (step S101). If such an address number has been received (YES, step S101), the controller 4 drives the alert section 5 to inform the user of the incoming call (step S102). Assume that the alert stop switch 7 is pressed (YES, step 103) or the lid 1*b* is opened (YES, step S104) while the alerting operation is under way. Then, the controller 4 stops the alerting operation (step S106). Further, if neither the alert stop switch 7 nor the lid 1*b* is manipulated within a predetermined period of time after the start of the alerting operation (NO, step 103 and NO, step 104), the controller 4 automatically resets the alert section 5 (YES, step S105) to stop the alerting operation (step S106).

In summary, it will be seen that the present invention provides a radio pager which automatically stops an alert indicative of an incoming all when the user of the pager opens a lid. This frees the user from a troublesome procedure including pressing a switch to stop an alert, opening a lid, and then reading a received message.

Various modifications will become possible for those skilled in the art after receiving the teachings of the present disclosure without departing from the scope thereof.

What is claimed is:

1. A radio pager having a pager body provided with a keyboard for implementing an electronic memorandum, a lid provided with a display for selectively displaying a received message or data meant for said electronic memorandum, and a hinge connecting said pager body and said lid, said radio pager comprising:

a first switch manually accessible when said lid is in both an open and a closed position;

a second switch positioned on said lid in contact with said pager body when said lid is in a closed position, said switch for detecting the opening of said lid; and alert stopping means, connected to said first switch and to said second switch, for stopping an alerting operation when said lid is opened as detected by said second switch and for stopping said alerting operation when said first switch is manually activated.

2. A radio pager as claimed in claim 1, further comprising a controller means for automatically stopping said alerting operation when said alerting operation is not stopped manually within a predetermined period of time after a start of said alerting operation.

* * * * *